US011187139B2

(12) United States Patent
Lee

(10) Patent No.: US 11,187,139 B2
(45) Date of Patent: Nov. 30, 2021

(54) ENGINE COOLING SYSTEM

(71) Applicants: HYUNDAI MOTOR COMPANY, Seoul (KR); KIA MOTORS CORPORATION, Seoul (KR)

(72) Inventor: Hyo-Jo Lee, Suwon-si (KR)

(73) Assignees: HYUNDAI MOTOR COMPANY, Seoul (KR); KIA MOTORS CORPORATION, Seoul (KR)

( * ) Notice: Subject to any disclaimer, the term of this patent is extended or adjusted under 35 U.S.C. 154(b) by 0 days.

(21) Appl. No.: 16/440,589

(22) Filed: Jun. 13, 2019

(65) Prior Publication Data

US 2020/0182129 A1 Jun. 11, 2020

(30) Foreign Application Priority Data

Dec. 11, 2018 (KR) ..... 10-2018-0159366

(51) Int. Cl.
*F01P 7/16* (2006.01)
*F01P 5/12* (2006.01)
*F01P 7/14* (2006.01)

(52) U.S. Cl.
CPC ..... *F01P 7/165* (2013.01); *F01P 5/12* (2013.01); *F01P 2007/146* (2013.01)

(58) Field of Classification Search
CPC F01P 11/04; F01P 2003/027; F01P 2007/143; F01P 2007/146; F01P 2025/32; F01P 3/02; F01P 5/12; F01P 7/16; F01P 7/165; F01P 2005/105; F01P 2005/125
See application file for complete search history.

(56) References Cited

U.S. PATENT DOCUMENTS 4,545,333 A * 10/1985 Nagumo ..... F01P 7/167 123/41.02
6,260,515 B1 * 7/2001 Tosaka ..... F01P 5/10 123/41.08
6,343,573 B1 * 2/2002 Takahashi ..... F01P 7/167 123/41.08
2002/0195067 A1 * 12/2002 Murakami ..... F01P 3/20 123/41.1
2004/0060524 A1 * 4/2004 Hwang ..... F02B 75/20 123/41.28
2004/0079298 A1 * 4/2004 Kobayashi ..... F01P 7/16 123/41.14
2006/0157002 A1 * 7/2006 Pfeffinger ..... F01P 7/165 123/41.29

(Continued)

FOREIGN PATENT DOCUMENTS

KR 101264576 B1 5/2013

*Primary Examiner* — Phutthiwat Wongwian
*Assistant Examiner* — Diem T Tran
(74) *Attorney, Agent, or Firm* — McDonnell Boehnen Hulbert & Berghoff LLP

(57) ABSTRACT

An engine cooling system may include a water pump for circulating coolant flowing in through a radiator flow path and a bypass flow path to an engine side through an engine cooling flow path, and a thermostat arranged at a fore end of the water pump. The engine cooling flow path is formed to be dualized and divided into a main flow path and a sub-flow path, and the thermostat controls flow rate of the coolant flowing out to the main flow path and the sub-flow path in response to temperature of the coolant flowing into the thermostat.

9 Claims, 6 Drawing Sheets

(56) References Cited

U.S. PATENT DOCUMENTS

| | | | | |
|---|---|---|---|---|
| 2007/0137592 | A1* | 6/2007 | Hanai | F01P 11/20 123/41.14 |
| 2010/0163215 | A1* | 7/2010 | Li | F04D 13/06 165/120 |
| 2011/0265742 | A1* | 11/2011 | Choi | F01P 7/161 123/41.09 |
| 2011/0296834 | A1* | 12/2011 | Kuhlbach | F02B 39/005 60/605.3 |
| 2012/0199084 | A1* | 8/2012 | Kinomura | F01P 7/165 123/41.08 |
| 2016/0281586 | A1* | 9/2016 | Hosokawa | F01P 11/16 |

* cited by examiner

ENGINE COOLING SYSTEM

CROSS REFERENCE TO RELATED APPLICATION

This application claims priority to Korean Patent Application No. 10-2018-0159366, filed on Dec. 11, 2018, the disclosure of which is incorporated herein by reference in its entirety.

BACKGROUND

Field of the Disclosure

Exemplary embodiments of the present disclosure relate to an engine cooling system for cooling an engine, which is configured to include a water pump.

Description of the Related Art

A cooling system for cooling an engine includes a water pump arranged at a fore end of the engine to circulate coolant to the engine.

Water pumps are divided into a mechanical water pump linked with an engine via a fan belt to be operated in proportion to the number of revolutions of the engine and a variable water pump that can be controlled in response to factors of the engine and environment irrespective of the number of revolutions of the engine.

The mechanical water pump is disadvantageous in terms of fuel efficiency because it cannot be controlled in response to factors of the engine and environment. The variable water pump is disadvantageous in terms of complexity of structure, function and manufacturing cost because it has a complicated structure and utilizes a control mechanism in order to control flow rate.

The above information disclosed in this Background section is only for assisting understanding of the background of the disclosure and it may therefore contain information that does not form the prior art that is already known to those who have ordinary skill in the art.

SUMMARY

The present disclosure has been made to solve the above-described problems associated with the prior art. An object of the present disclosure is to provide an engine cooling system capable of controlling flow rate of coolant to be supplied to cooling and heating components by a water pump in a wide range and increasing the maximum flow rate.

Other objects and advantages of the present disclosure can be understood by the following description and become apparent with reference to the embodiments of the present disclosure. Also, it is obvious to those skilled in the art to which the present disclosure pertains that the objects and advantages of the present disclosure can be realized by the means as claimed and combinations thereof.

In accordance with one aspect of the present disclosure, there is provided an engine cooling system comprising: a water pump for circulating coolant flowing in through a radiator flow path and a bypass flow path to an engine side through an engine cooling flow path; and a thermostat arranged at a front or fore end of the water pump, wherein the engine cooling flow path is formed to be dualized and divided into a main flow path and a sub-flow path, and the thermostat controls flow rate of the coolant flowing out to the main flow path and the sub-flow path in response to temperature of the coolant flowing into the thermostat.

Further, the thermostat comprises a main valve arranged at a side of the radiator flow path to open and close the radiator flow path and a sub-valve arranged at a side of the bypass flow path to open and close the bypass flow path and the sub-flow path.

The main valve and the sub-valve are configured to be operated to open and close the respective flow paths by means of change in volume of wax provided in the thermostat.

Further, the sub-valve is configured to be operated to open the sub-flow path while closing the bypass flow path or to open the bypass flow path while closing the sub-flow path.

Further, the main valve and the sub-valve are configured to be operated in cooperation with each other.

Accordingly, when the main valve opens the radiator flow path, the sub-valve closes the bypass valve so that the coolant flowing in through the radiator flow path flows out through the main flow path and the sub-flow path.

In addition, when the sub-valve opens the bypass flow path, the main valve closes the radiator flow path so that the coolant flowing in through the bypass flow path flows out through the main flow path.

On the other hand, the water pump may comprise a main impeller arranged in the main flow path and coupled to a shaft rotated by an electric motor so as to rotate.

Further, the water pump may comprise a sub-impeller arranged in the sub-flow path and coupled to the shaft so as to rotate.

According to the engine cooling system of the present disclosure, the engine cooling flow path is separated such that flow rate of the coolant can be controlled variably even by a single water pump.

Moreover, it is possible to further improve fuel efficiency and performance by controlling flow rate of the coolant in response to temperature of the coolant.

It is to be understood that both the foregoing general description and the following detailed description of the present disclosure are exemplary and explanatory and are intended to provide further explanation of the disclosure as claimed.

BRIEF DESCRIPTION OF THE FIGURES

The above and other objects, features and other advantages of the present disclosure will be more clearly understood from the following detailed description taken in conjunction with the accompanying drawings, in which.

DETAILED DESCRIPTION

In order to fully understand the present disclosure, operational advantages of the present disclosure and objects achieved by implementing the present disclosure, the accompanying drawings exemplifying preferred embodiments of the present disclosure and contents described in the accompanying drawings need to be referred to.

In describing the preferred embodiments, detailed description of technology known in the art or iterative description may be made shortly or omitted to avoid obscuring the subject matter of the present disclosure.

Figure 1:
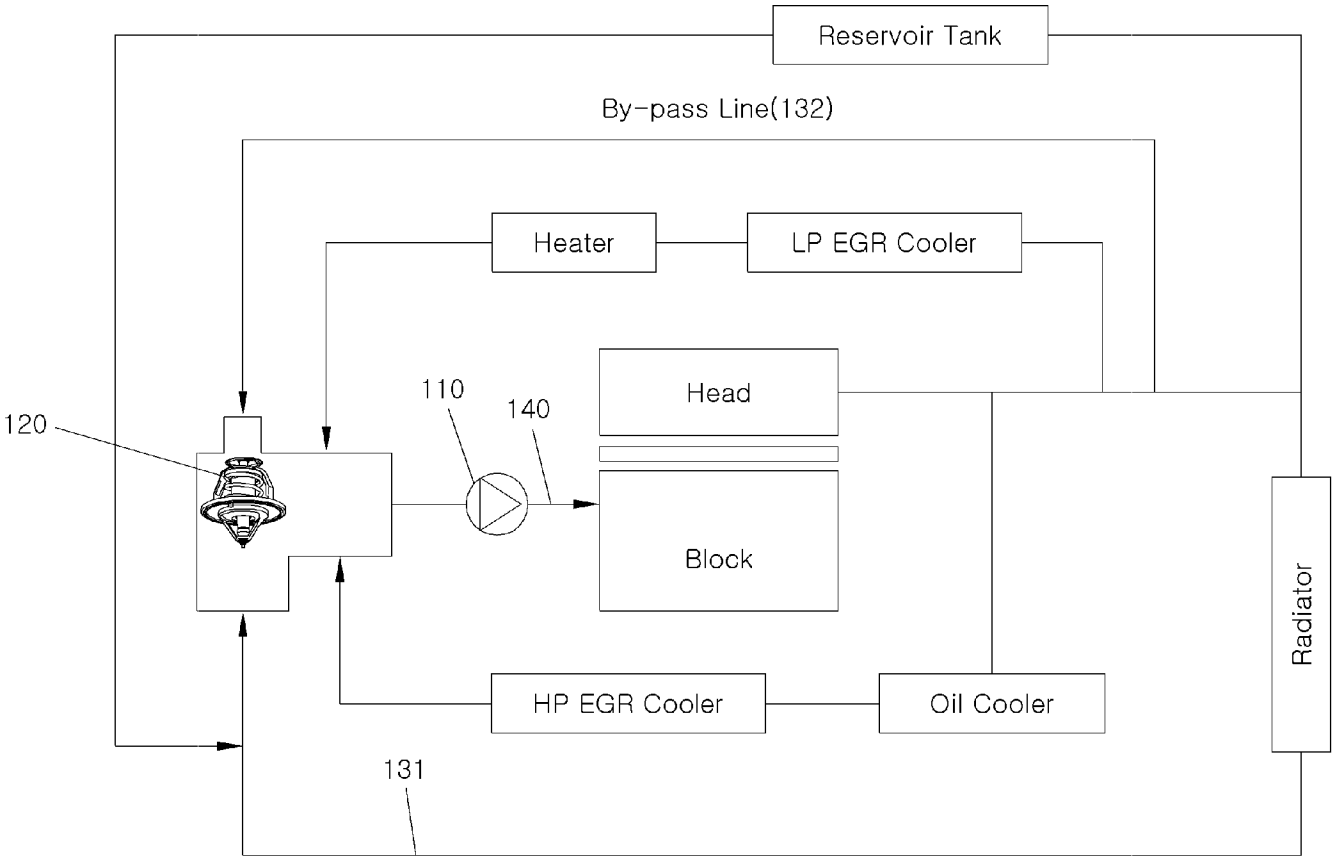
FIG. 1 is a schematic diagram of an engine cooling system according to an embodiment of the present disclosure.
Figure 2:
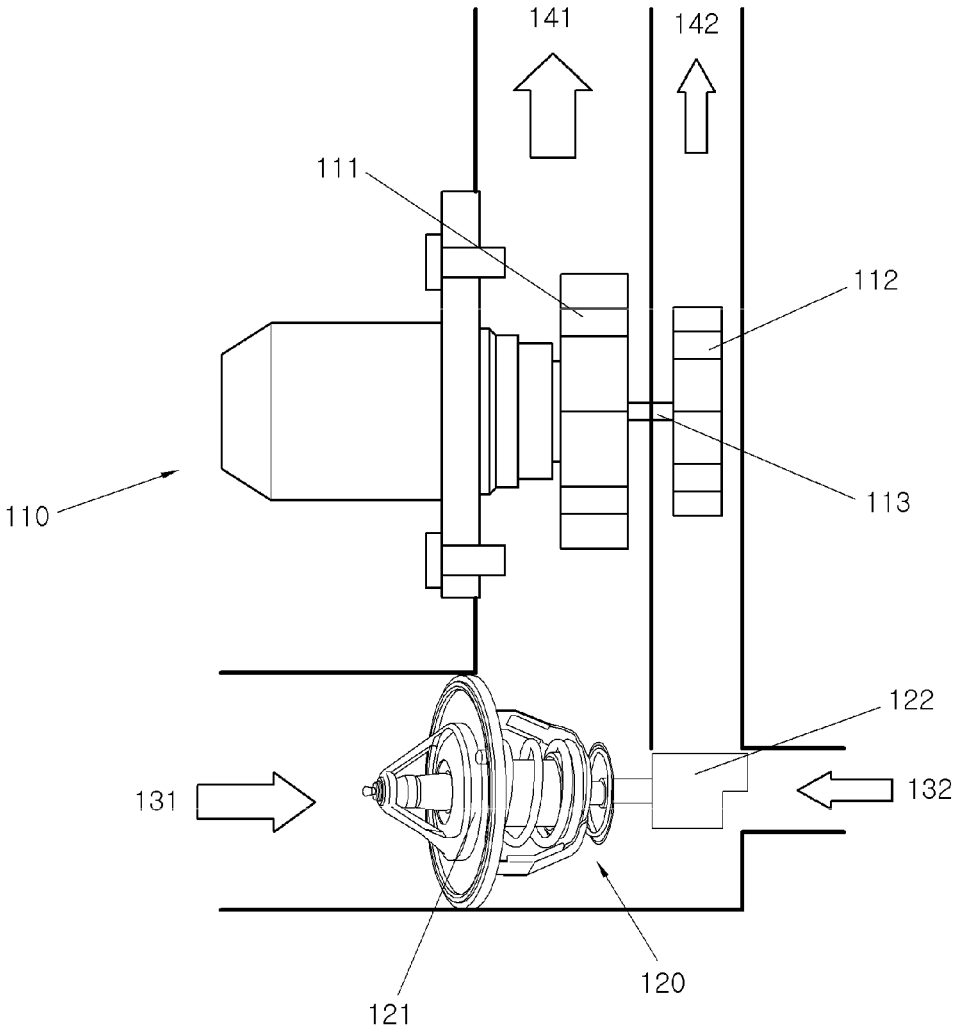
FIG. 2 is a partial diagram illustrating arrangement of a water pump and a thermostat, according to an embodiment of the present disclosure.

FIG. 1 is a schematic diagram of an engine cooling system according to an embodiment of the present disclosure and FIG. 2 is a partial diagram illustrating arrangement of a water pump and a thermostat, according to the embodiment of the present disclosure.

Hereinafter, the engine cooling system according to the embodiment of the present disclosure will be described with reference to FIGS. 1 and 2.

The engine cooling system according to the embodiment of the present disclosure is configured such that heat generated in an engine (engine head and engine block) is discharged to the atmosphere by a radiator through which coolant circulates and a water pump 110 is arranged at a front or fore end of the engine to supply the coolant to the engine.

In addition, the coolant that has cooled the engine is supplied to the water pump 110 via the radiator through a radiator flow path 131 and the coolant having been bypassed is supplied to the water pump 110 through a bypass flow path (or bypass line) 132.

The water pump 110 supplies the coolant flowing in through the radiator flow path 131 and the bypass flow path 132 to the engine through an engine cooling flow path 140 wherein the engine cooling system according to the embodiment of the present disclosure is characterized in that the engine cooling flow path 140 is dualized, i.e., divided into a main flow path 141 and a sub-flow path 142.

To this end, it is contemplated that the water pump 110 has a two-stage structure including a main impeller 111 and a sub-impeller 112, and the engine cooling system includes a thermostat 120 arranged at a front or fore end of the water pump 110 to control outflow of the coolant to the main flow path 141 and the sub-flow path 142.

In other words, the radiator flow path 131 and the bypass flow path 132 pass through the thermostat 120 arranged at the fore end of the water pump 110, and the thermostat 120 includes a main valve 121 and a sub-valve 122 such that supply of the coolant to the main flow path 141 and the sub-flow path 142 can be controlled in response to temperature of the coolant.

The main valve 121 is arranged in the radiator flow path 131 to open and close the radiator flow path 131 while the sub-valve 122 is arranged in the bypass flow path 132 to open and close the bypass flow path 132 and the sub-flow path 142.

The main valve 121 and the sub-valve 122 are coupled to different sides of wax provided in a housing of the thermostat 120, respectively, to be operated to open and close the respective flow paths by being displaced by means of change in volume of the wax.

In addition, the water pump 110 is configured to allow the main impeller 111 and the sub-impeller 112 to be coupled to a shaft 113 rotated by an electric motor such that the impellers rotate together with the water pump, thereby supplying the coolant smoothly. In this case, the main impeller 111 is arranged in the main flow path 141 while the sub-impeller 112 is arranged in the sub-flow path 142.

Further, in some embodiments, only one impeller out of the main impeller 111 and the sub-impeller 112 is included in the engine cooling system, if necessary.

Figure 3:
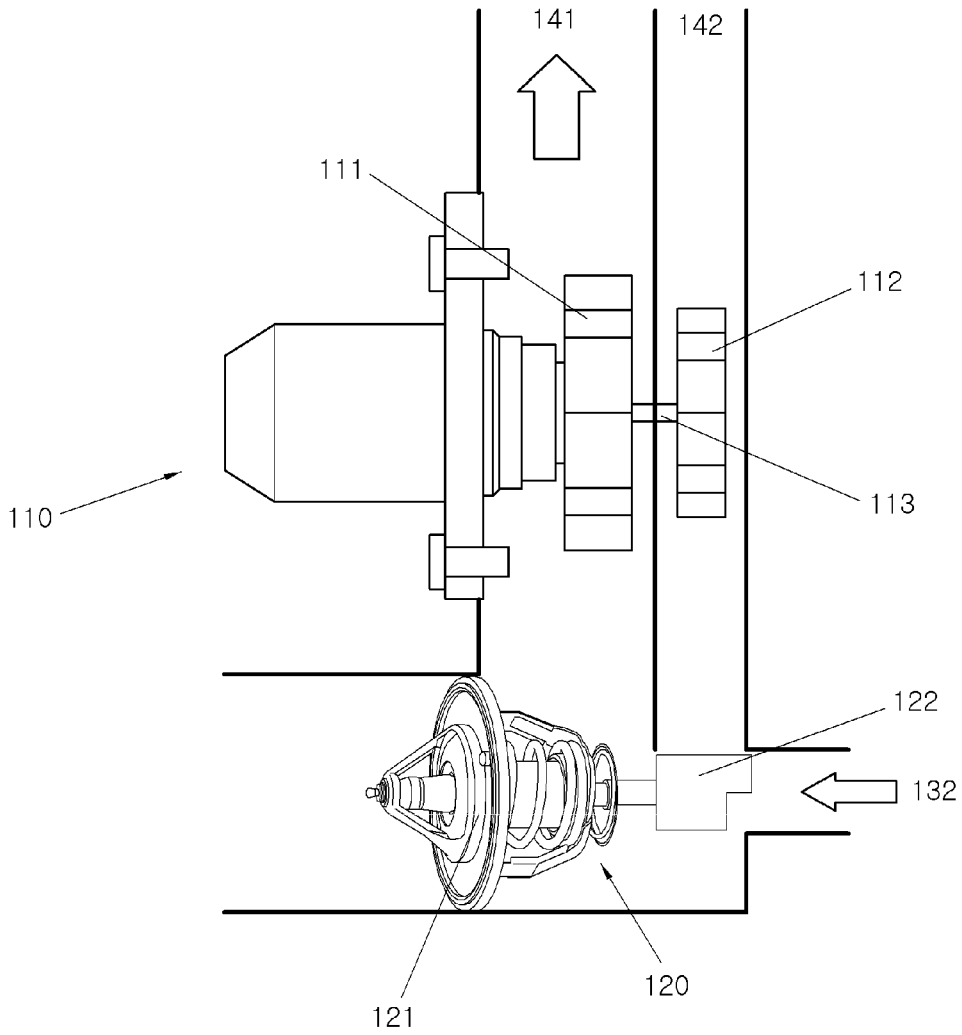
FIGS. 3, 4, and 5 illustrate operating conditions of the water pump and the thermostat in an embodiment of the present disclosure.
Figure 4:
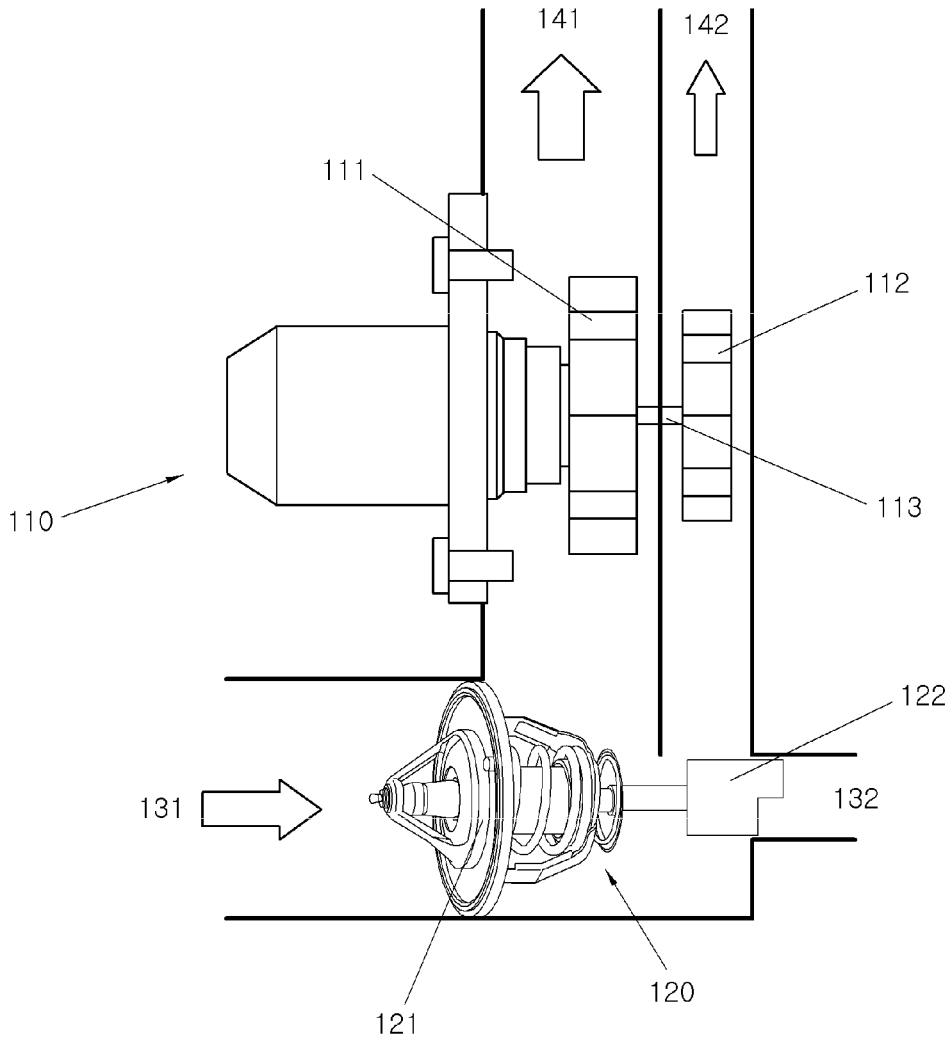
Figure 5:
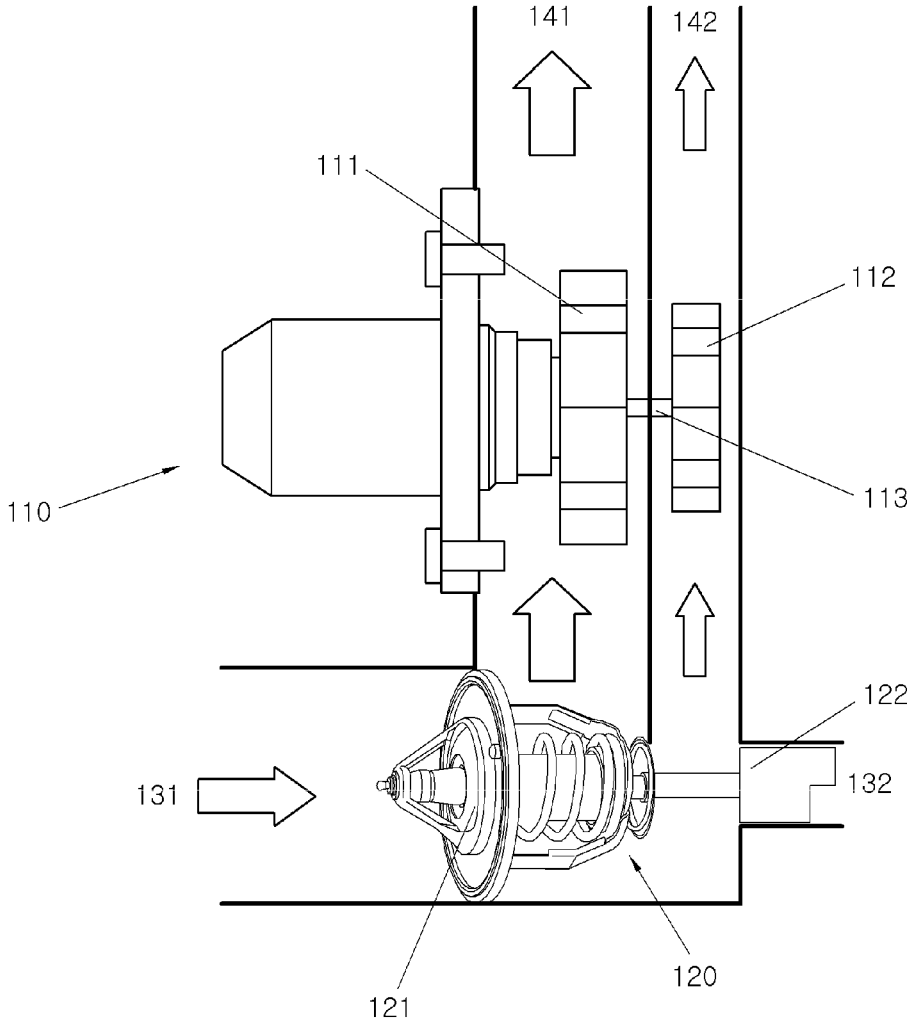

FIGS. 3 to 5 illustrate operating conditions of the water pump and the thermostat in the embodiment of the present disclosure.

FIG. 3 shows the case of a cold condition in which temperature of the coolant is low. In this case, since temperature of the coolant is low, the coolant that has cooled the engine flows into the thermostat 120 through the bypass flow path 132 while the main valve 121 closes the radiator flow path 131 and the sub-valve 122 closes the sub-flow path 142.

Accordingly, the coolant flowing in through the bypass flow path 132 is circulated back to the engine side through the main flow path 141 and in turn temperature of the coolant and oil is rapidly increased so that friction is reduced. Further, it is possible to shorten speed of engine warm-up and improve heating performance.

FIG. 4 shows the case of a high temperature condition in which temperature of the coolant is high. In this case, since volume of the wax is changed by temperature of the coolant, the main valve 121 is operated to open the radiator flow path 131 to a certain degree and the sub-valve 122 is operated to close the bypass valve 132 and open the sub-flow path 142 to a certain degree. Accordingly, circulating flow rate of the coolant is increased.

Next, FIG. 5 shows the case of a hot condition in which temperature of the coolant is at a maximum. In this case, since change in volume of the wax is at a maximum, the main valve 121 is operated to open the radiator flow path 131 to the maximum and the sub-valve 122 is operated to close the bypass valve 132 and open the sub-flow path 142 to the maximum.

As a result, flow rate of the coolant to be circulated is controlled to be at a maximum so that cooling performance is improved and durability of the engine is ensured by virtue of increase of the flow rate.

Figure 6:
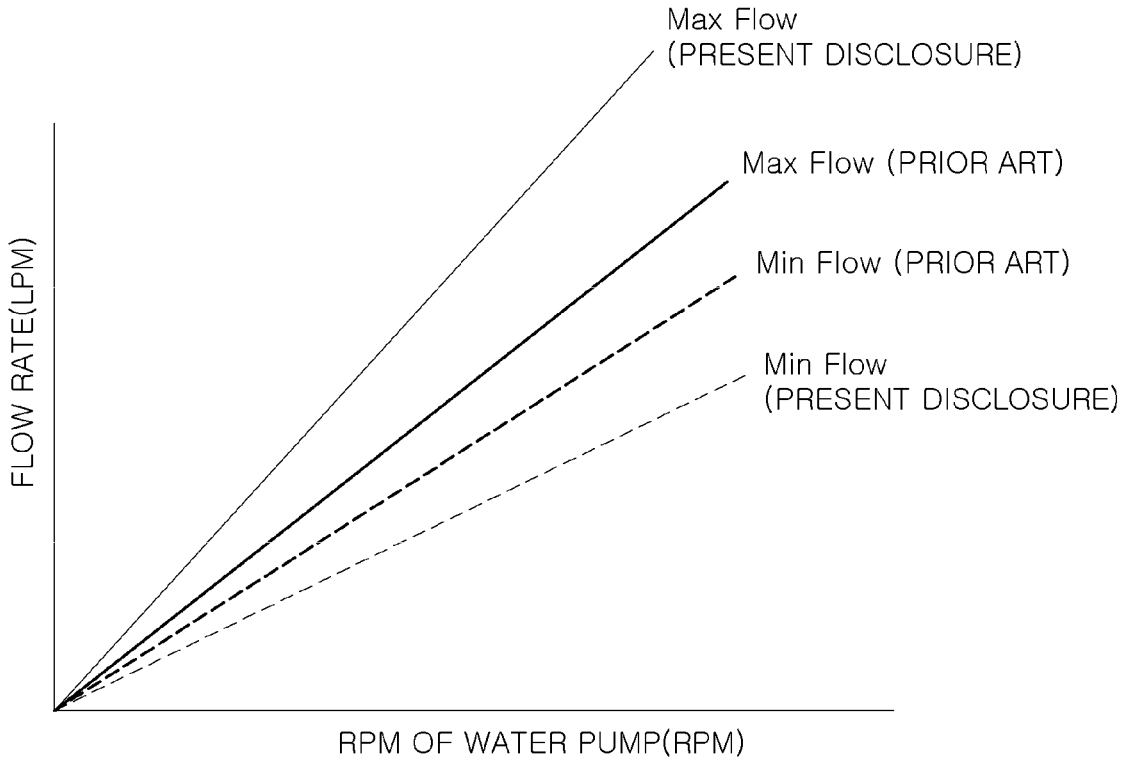
FIG. 6 shows a result in which control range of flow rate of coolant is enlarged by an engine cooling system according to an embodiment of the present disclosure.

FIG. 6 shows a result in which control range of flow rate of the coolant is increased by the engine cooling system according to the embodiment of the present disclosure, the maximum flow rate (Inventive Max Flow) and the minimum flow rate (Inventive Min Flow) in the embodiment of the present disclosure are greater compared to the maximum flow rate (Comparative Max Flow) and the minimum flow (Comparative Min Flow) in the prior art.

In this way, embodiments of the present disclosure make it possible to increase control range of flow rate of coolant, thereby significantly improving cooling performance as well as heating performance and fuel efficiency.

Although the present disclosure has been described in the foregoing with reference to the drawings illustrated by way of an example, the present disclosure is not limited to the disclosed embodiments and it is apparent to those of ordinary skill in the art that various modifications and variations can be made to the present disclosure without departing from the spirit and scope of the disclosure. Therefore, such modifications or variations fall within the scope of the present disclosure as claimed and the scope of the present disclosure should be interpreted based on the appended claims.

The invention claimed is:

1. An engine cooling system comprising:

a water pump for circulating a coolant flowing in through a radiator flow path and a bypass flow path to an engine side through an engine cooling flow path; and a thermostat arranged at a fore end of the water pump, wherein the engine cooling flow path from the thermostat to the engine is dualized after the thermostat, and the engine cooling flow path is divided into a main flow path and a sub-flow path, and the thermostat controls flow rate of the coolant flowing out to the main flow path and the sub-flow path in response to a temperature of the coolant flowing into the thermostat, wherein the thermostat comprises a main valve arranged at a side of the radiator flow path to open and close the radiator flow path and a sub-valve arranged at a side of the bypass flow path to open and close the bypass flow path and the sub-flow path;

wherein the main flow path is opened and the sub flow path is closed when the temperature of the coolant is low in a cold condition;

wherein the main flow path is opened and the sub flow path is partially opened when the temperature of the coolant is high in a high temperature condition; and wherein the main flow path is opened and the sub flow path is fully opened when the temperature of the coolant is at a maximum temperature.

2. The engine cooling system according to claim 1, wherein the main valve and the sub-valve are configured to be operated to open and close the respective flow paths by means of change in volume of wax provided in the thermostat.

3. The engine cooling system according to claim 1, wherein the sub-valve is configured to be operated to open the sub-flow path while closing the bypass flow path or to open the bypass flow path while closing the sub-flow path.

4. The engine cooling system according to claim 1, wherein the main valve and the sub-valve are configured to be operated in cooperation with each other.

5. The engine cooling system according to claim 4, wherein when the main valve opens the radiator flow path, the sub-valve closes the bypass flow path so that the coolant flowing in through the radiator flow path flows out through the main flow path and the sub-flow path.

6. The engine cooling system according to claim 4, wherein when the sub-valve opens the bypass flow path, the main valve closes the radiator flow path so that the coolant flowing in through the bypass flow path flows out through the main flow path.

7. The engine cooling system according to claim 1, wherein the water pump comprises a main impeller arranged in the main flow path and coupled to a shaft rotated by an electric motor so as to rotate.

8. The engine cooling system according to claim 7, wherein the water pump further comprise a sub-impeller arranged in the sub-flow path and coupled to the shaft so as to rotate.

9. The engine cooling system according to claim 1, wherein the water pump comprises a sub-impeller arranged in the sub-flow path and coupled to a shaft rotated by an electric motor so as to rotate.

* * * * *